US006357428B1

(12) United States Patent
Baumberger et al.

(10) Patent No.: US 6,357,428 B1
(45) Date of Patent: Mar. 19, 2002

(54) PROCESS AND APPARATUS FOR DETERMINING THE BREAKDOWN VOLTAGE DURING THE IGNITION OF AN INTERNAL-COMBUSTION ENGINE

(75) Inventors: Heinz Baumberger, Berlin; Ingo Gabriel, Karlsruhe; Peter Hohner, Leinfelden-Echterdingen; Hartung Wilstermann, Gaildorf, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/346,582

(22) Filed: Jul. 2, 1999

(30) Foreign Application Priority Data

Jul. 2, 1998 (DE) ..... 198 29 583

(51) Int. Cl.[7] ..... F02P 1/00
(52) U.S. Cl. ..... 123/644
(58) Field of Search ..... 123/644

(56) References Cited

U.S. PATENT DOCUMENTS 4,915,086 A * 4/1990 Ciliberto et al. ..... 123/644
4,933,861 A * 6/1990 Allen et al. ..... 123/644
5,370,099 A * 12/1994 Koelle et al. ..... 123/644
5,606,118 A 2/1997 Muth et al.
5,758,629 A * 6/1998 Bahr et al. ..... 123/644
5,895,839 A * 4/1999 Takahashi et al. ..... 123/406.26

FOREIGN PATENT DOCUMENTS

| | | |
|---|---|---|
| DE | 27 52 244 | 6/1979 |
| DE | 30 41 498 | 6/1982 |
| DE | 40 37 071 | 5/1991 |
| DE | 43 03 030 | 9/1993 |
| DE | 195 20 852 | 9/1996 |
| DE | 196 52 896 | 6/1998 |
| WO | WO 92/20912 | 11/1992 |

* cited by examiner

*Primary Examiner*—John Kwon
(74) *Attorney, Agent, or Firm*—Crowell & Moring LLP

(57) ABSTRACT

A process and apparatus for determining the breakdown voltage in the case of an ignition of a vehicle is provided. The breakdown point in time is detected and the breakdown voltage is determined based on the breakdown point in time.

6 Claims, 1 Drawing Sheet

Fig. 1
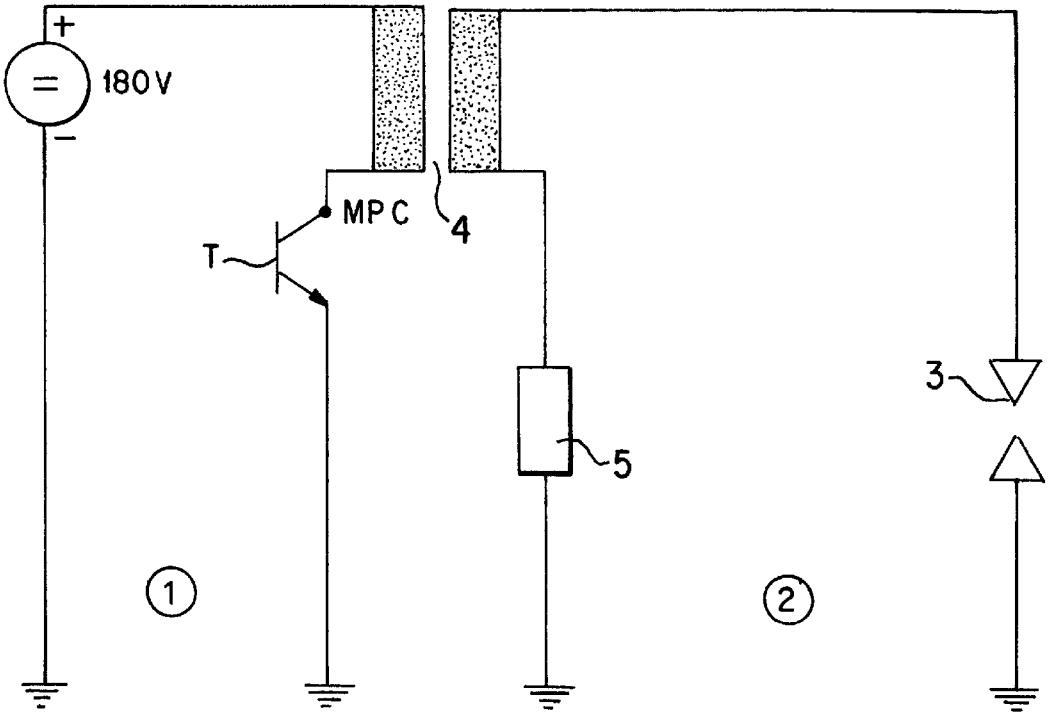
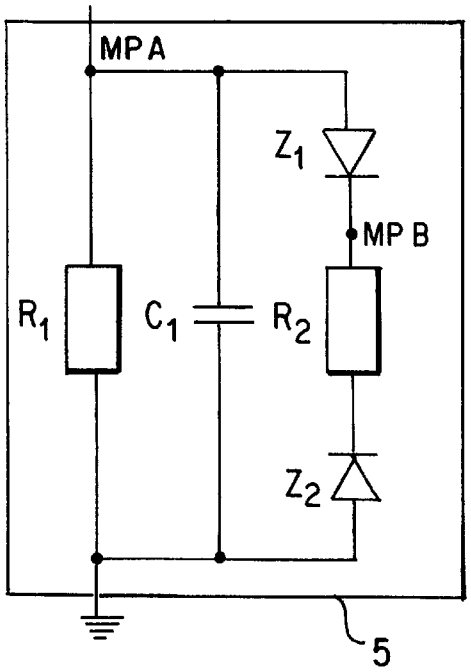
Fig. 2
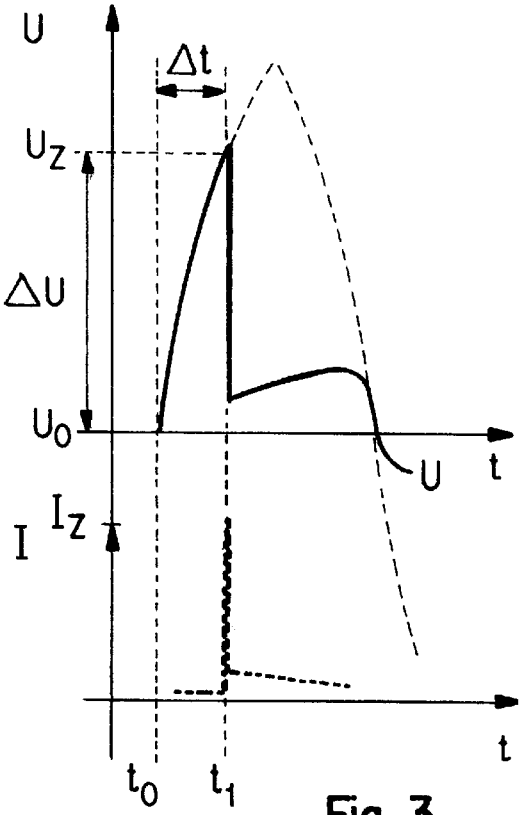
Fig. 3

PROCESS AND APPARATUS FOR DETERMINING THE BREAKDOWN VOLTAGE DURING THE IGNITION OF AN INTERNAL-COMBUSTION ENGINE

BACKGROUND AND SUMMARY OF THE INVENTION

This application claims the priority of German Application No. 198 29 583.9, filed Jul. 2, 1998, the disclosure of which is expressly incorporated by reference herein.

The invention relates to a process for determining the breakdown voltage during the ignition of an internal-combustion engine and to an apparatus for performing the process.

German Patent Document DE 27 52 244 A1 describes, for example, a process and apparatus for testing an electric ignition. For rapidly testing the component parts in their operative position, the time sequence of the voltage is measured on the primary winding side and/or on the secondary winding side. On the basis of the voltage time sequence, a conclusion is drawn, for example, about the spark gap or concerning moisture in the distributor. A current drop which is too fast indicates a spark gap which is too large, corresponding with electrode consumption. A current drop which is too slow, in contrast, indicates a spark gap which is too small. The course of the voltage in the secondary winding can also be measured by the falling voltage in the primary winding.

In German Patent Documents DE 30 41 498 A1 and DE 40 37 071 A1, it is suggested to detect the breakdown point in time during the ignition and, as a function thereof, draw a conclusion concerning the condition of the ignition system. In German Patent Document DE 30 41 498 A1, a negative flank pulse is generated at the point in time of the ignition, which flank, by way of a coupling capacitor and a comparator, resets a flip-flop. The comparator is used for recognizing this negative impulse. The tapping of the ignition signal takes place on the primary side. In German Patent Document DE 40 37 071 A1, a conclusion is drawn about the quality of the ignition system from the time period which passes between the rise of the primary voltage of the ignition coil and the lowering of the current in a limiting circuit. For this purpose, the point in time of the rise of the primary voltage of the ignition coil is determined. This rising point in time is caused by the switching-off of the switching transistor in the range of the ignition point in time. The point in time of the falling of the current in the limiting circuit is determined. This falling point in time is caused by the spark discharge at the ignition point in time.

German Patent Document DE 43 03 030 A1 discloses a method and a system for monitoring the ignition behavior in the case of capacitance discharge ignition systems. In this case, the ignition voltage required for igniting a spark plug is determined from the duration of the current flow through the ignition coil primary winding. Since the coil coupling is low in the case of alternating-voltage ignitions, however, a qualitative measurement of the current change and/or voltage change on the primary side of the ignition is not possible. In the case of alternating-voltage ignitions, for the direct measurement of the breakdown voltage on the secondary side, a high-voltage sensing probe is therefore used. However, a high-voltage sensing probe is expensive.

It is an object of the invention to provide an inexpensive and simple process for determining the breakdown voltage and thus diagnosing the engine and testing the ignition system.

According to the invention, this object is achieved by a process for determining the breakdown voltage in the case of the ignition of an internal-combustion engine, characterized in that the breakdown point in time is determined and the breakdown voltage is determined based on the breakdown point in time. A system for performing the method is characterized in that the detection of the breakdown point in time is carried out by a time-dependent current or voltage measurement either on the primary side of the ignition system at a measuring point, which is situated at the connection of the ignition coil primary winding not connected with the supply voltage, or on the secondary side of the ignition system on the low-voltage side at other measuring points.

Advantageous further developments of the object of the invention are described herein.

An important advantage of these further developments is the fact that the voltage measurement is only qualitatively carried out. The value of the breakdown voltage is not measured directly but only the breakdown point in time is determined by measuring the voltage. By detecting the breakdown time, the breakdown voltage is determined in a simpler and more precise manner. This simplifies any type of testing of the ignition system or of the engine diagnosis during which the breakdown voltage is used as an indicator. Because of its precision, a qualitative measuring of the voltage or of the current is advantageous. For this reason, the amount of time before the breakdown is determined. Since at the ignition point in time, the voltage breaks through at the electrodes of the spark plug and there is a large current flow, a large drop of the voltage takes place at the spark plug at the ignition point in time. Since the voltage drop at the ignition point in time can be determined very intensively and therefore precisely, it is advantageous, particularly in the case of alternating-voltage ignitions, that, on the primary side, the measuring the voltage provides an informative value of the breakdown time and thus of the breakdown voltage.

In the case of alternating-voltage ignitions, because of the low coil coupling, the breakdown voltage on the primary side cannot be measured quantitatively. However, it is possible to recognize the abrupt voltage drop at the ignition point in time by measuring the voltage on the primary side. The breakdown point in time is detected by way of the voltage drop. However, a direct measurement of the breakdown voltage from a voltage measurement is not possible. By comparing, in an engine control unit (ECU) for example, the detected breakdown point in time with a time-dependent characteristic voltage diagram determined previously in an empirical or theoretical manner, the breakdown voltage is determined very precisely.

By means of the breakdown voltage, all other factors which depend on the breakdown voltage can be determined. These include, in particular, the testing of the ignition system as well as the direct engine diagnosis. As a result of the determination of the breakdown voltage, a spark plug diagnosis in a cold test as well as during engine operation can be carried out. Furthermore, the engine tightness can be tested in the cold test. In addition, the combustion space pressure can be determined during the cold test and during the operation of the engine. The determination of the spark gaps and the testing of the spark plugs with respect to an insulator breakage can also be carried out by means of determining the breakdown voltage.

Other objects, advantages and novel features of the present invention will become apparent from the following detailed description of the invention when considered in conjunction with the accompanying drawings.

BRIEF DESCRIPTION OF THE DRAWINGS

FIG. 1 is a circuit wiring diagram of an ignition;

FIG. 2 is a circuit wiring diagram of a measuring device according to the invention; and FIG. 3 is a characteristic curve of voltage/current with respect to time of the spark plug with and without the occurrence of a breakdown.

DETAILED DESCRIPTION OF THE DRAWINGS

FIG. 1 is a circuit wiring diagram of an alternating-voltage ignition. The Transistor $T_1$ provides that the alternating voltage is regulated about a current on the gate of the transistor. However, the invention is also suitable for other ignitions, such as, for example, a direct-voltage ignition. The voltage is transformed-up on the secondary side 2 by means of a transformer 4 to the breakdown voltage $U_z$ of the spark plug 3. When the breakdown voltage $U_z$ has been reached, the spark plug 3 breaks down and the ignition current $I_z$ flows (see also FIG. 3). For determining the breakdown voltage $U_z$, the time $t_0$ from the zero crossing of the voltage to the time $t_1$ at which the breakdown point is reached is detected. This can take place by means of a current or voltage measuring device 5, coupled on the low voltage side (on the secondary side 2) of the ignition. Another possibility is, for example, to make a current or voltage measurement at the measuring point MPC on the primary side 1. At the point in time of the breakdown, an abrupt voltage change takes place at the point MPC. This voltage change and thus the point in time $t_1$ can be clearly detected. By contrast, the voltage measurement does not furnish the exact breakdown voltage $U_z$.

FIG. 2 is a circuit wiring diagram of a first embodiment of the measuring device 5. At the measuring point MPA, the voltage drop on the resistor $R_1$ can be measured. Another process for detecting the breakdown time $t_1$ is to measure at the measuring point MPB during the breakdown. During the breakdown, a large current flows. This large current can be measured at the measuring point MPB. As soon as the voltage reaches the Zener breakdown voltage, the Zener diodes $Z_1$ and $Z_2$ break down and current flows through the resistor $R_2$. The voltage drop at the resistor $R_2$ is measured. Since the embodiment is an alternating-voltage ignition, the voltage drop at the resistor $R_2$ is bounded by two Zener diodes $Z_1$ for the positive and $Z_2$ for the negative half-wave of the alternating voltage. In the case of direct voltage ignitions, one Zener diode is sufficient for limiting the voltage on a resistor and thus for detecting the breakdown point in time $t_1$ during the ignition. Capacitor $C_1$ provides required suppression of high frequencies caused by spark plug disturbances.

FIG. 3 shows the characteristic curves of the spark plugs 3 with and without a breakdown. In a simplifying manner, only the positive half-wave is illustrated. In the case of alternating voltage ignitions, a breakdown is possible also in the negative half-wave. The upper diagram shows the time-dependent characteristic voltage curve. The lower diagram shows the time-dependent characteristic current curve. In the upper diagram, the characteristic curve in which a breakdown does not occur is shown in broken line. The characteristic curve without a breakdown is obtained empirically by measurement or theoretically by calculation without a spark plug. This characteristic curve is used for determining the functional value of the ignition voltage $U_z$. The zero crossing of the voltage U is defined as the functional value $U_0/t_0$; the breakdown is defined as the functional value $U_z/t_1$. The dark line in the upper diagram shows the voltage course and, in the lower diagram, the current course at the spark plug with a breakdown. The voltage rises continuously starting at $t_0$ until the spark plug 3 breaks down at the breakdown point in time $t_1$. The ignition current $I_z$ flows at the breakdown point in time $t_1$. By determining $t_1$, the breakdown voltage $U_z$can be determined by a comparison with the time-dependent characteristic voltage curve without breakdown.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An apparatus, for obtaining a breakdown voltage of an ignition system in an internal combustion engine, comprising:

measuring means for determining a breakdown point in time during operation of the ignition system of the internal combustion engine, said measuring means including means for measuring one of a time-dependent current and voltage on a primary side of the ignition system at a first measuring point at a connection of an ignition coil primary winding which is not coupled with a supply voltage, or on a secondary side of the ignition system on at least one secondary measuring point on a low-voltage side, wherein said breakdown point in time determine a location on a predetermined voltage curve of the operation of the ignition system without a breakdown and wherein said predetermined point is the breakdown voltage of the ignition system.

2. The apparatus according to claim 1, wherein said means for measuring the breakdown point in time on the secondary side of the ignition system comprises a resistor across which a voltage drop is measured.

3. The apparatus according to claim 1, wherein said means for measuring the breakdown point in time on the secondary side of the ignition system during operation of the ignition comprises a resistor protected via a Zener diode, a voltage drop across the resistor being measured.

4. The apparatus according to claim 1, wherein said ignition system is an alternating-voltage ignition, and further wherein the means for measuring the breakdown point in time on the secondary side during operation of the ignition system comprises a resistor bounded by two Zener diodes, a voltage drop being measured at the resistor.

5. An apparatus for determining a breakdown voltage during operation of an ignition system of an internal-combustion engine, the apparatus comprising:

a transformer of the ignition system, the transformer having a primary winding coupled at one end to a supply voltage and a secondary winding coupled at one end to a spark plug;

a measuring device coupled on a low-voltage side of the secondary winding of the ignition system, the measurement device comprising one of a first resistor coupled in series with ground and a second resistor coupled in series with a Zener diode between the secondary winding and ground, a voltage drop being measured across one of said first and second resistors, respectively, to detect a breakdown point in time of the ignition system; and a control unit storing a time-dependent characteristic voltage curve, said control unit receiving the detected breakdown point in time and comparing it with said time-dependent characteristic voltage curve to determine a breakdown voltage.

6. The apparatus according to claim 5, wherein for an alternating-voltage ignition, the measuring device comprises an additional Zener diode bounding the second resistor coupled in series with ground.

* * * * *